US007895806B2

(12) United States Patent
Avila

(10) Patent No.: US 7,895,806 B2
(45) Date of Patent: Mar. 1, 2011

(54) INTERLOCKING WALL SECTIONS FOR REFRIGERATED ENCLOSURES

(75) Inventor: Luis F. Avila, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 805 days.

(21) Appl. No.: 11/884,112

(22) PCT Filed: Dec. 22, 2005

(86) PCT No.: PCT/US2005/046569

§ 371 (c)(1),
(2), (4) Date: Aug. 9, 2007

(87) PCT Pub. No.: WO2007/073372

PCT Pub. Date: Jun. 28, 2007

(65) Prior Publication Data

US 2008/0136302 A1 Jun. 12, 2008

(51) Int. Cl.
*E04B 2/00* (2006.01)

(52) U.S. Cl. ..... 52/588.1; 52/783.1; 52/783.16

(58) Field of Classification Search ..... 52/783.1, 52/783.16, 784.13, 784.1, 91.3, 588.1, 309.11, 52/330

See application file for complete search history.

(56) References Cited

U.S. PATENT DOCUMENTS 445,262 A * 1/1891 Kinnear ..... 52/784.13
1,680,538 A * 8/1928 Gross ..... 52/783.12
1,797,706 A 3/1931 Winslow
3,540,116 A * 11/1970 Bohnsack et al. ..... 29/430
3,596,424 A * 8/1971 Ward ..... 52/330
3,786,613 A 1/1974 Shepheard
3,909,918 A * 10/1975 Takizawa et al. ..... 29/509
4,183,393 A 1/1980 Bailey
4,583,796 A 4/1986 Nakajima et al.
4,635,421 A 1/1987 Newberg
5,533,312 A 7/1996 Mihalcheon (Continued)

OTHER PUBLICATIONS

International Preliminary Report on Patentability mailed Jul. 3, 2008, 5 pgs.

*Primary Examiner*—Basil Katcheves
(74) *Attorney, Agent, or Firm*—Marjama Muldoon Blasiak & Sullivan LLP

(57) ABSTRACT

Interlocking insulated wall sections (20-24), each of which contains a shell (30) having an outer panel (33) and a pair of end walls (35-36). A cover (31) is having an inner panel (38) and two end walls (39-40) is fitted over the shell. A first end wall (39) of the cover is mounted in contact with an end wall (35) of the shell and a second end wall (40) of the cover passes into the shell between the two end walls of the shell. An L-shaped flange (43) is connected to the second end wall of the cover and has a first leg of the flange (44) that rests in contact with the inner panel and a second leg of the flange (45) rests in contact with the other end wall of the shell. A space (50) is thus provided between the two panels of the wall section and is filled with an insulation (55). Each wall section is dimensioned so that it can be received in the opening between the second end wall of the cover and the end flange so that two wall sections can be interlocked together in assembly.

12 Claims, 4 Drawing Sheets

U.S. PATENT DOCUMENTS 5,953,880 A * 9/1999 De Zen ..... 405/257
6,098,368 A 8/2000 McKann
6,311,454 B1 * 11/2001 Kempel ..... 52/784.15
6,460,955 B1 10/2002 Vaughan et al.
6,481,179 B2 11/2002 Zen
6,694,702 B2 2/2004 Weymer et al.

* cited by examiner

INTERLOCKING WALL SECTIONS FOR REFRIGERATED ENCLOSURES

FIELD OF THE INVENTION

This invention relates generally to interlocking insulated wall sections for use in the construction of structurally sound refrigerated enclosures.

BACKGROUND OF THE INVENTION

This invention relates more specifically to interlocking wall sections that are ideally suited for use in the construction of refrigerated merchandisers having an enclosed compartment for holding products in a relatively cool or cold environment. Many prior art refrigerated enclosures of this type employ modular corner units to attach the various insulated wall pieces in assembly. This type of construction required the use of a relatively large number of parts and the joints created by the modular corners are generally difficult to align and require special insulation and a large number of mechanical fasteners to complete. In addition, this type of construction does not allow for off-line fabrication of the various wall sections as subassemblies.

SUMMARY OF THE INVENTION

It is an object of this invention to improve the structural and thermal integrity of refrigerated enclosures.

It is a further object of the present invention to provide for improved structural joints at the corners of insulated walls of a refrigerated enclosure.

A still further object of the present invention is to improve the ease of assembly of a refrigerated assembly such as refrigerated merchandiser.

Another object of the invention is to allow for the off-line assembly of insulated wall sections of a refrigerated container whereby the sections can be easily brought together and interlocked in place at final assembly.

Yet another object of the present invention is to minimize the number of parts required to assemble a refrigerated enclosure.

These and other objects of the invention are attained by a wall section that contains a shell having an outer panel and two end walls integral with the outer panel that are mounted perpendicular to the outer panel. A cover is mounted over the shell that has an inner panel and a first end wall and a second end wall. The first end wall of the cover is in contact with one end wall of the shell and the second end wall of the cover passes into the shell between one end wall of the shell and the other end wall of the tray. An L-shaped flange having a first leg that is connected to the distal end of the second end wall of the cover and a second leg that is mounted in contact with the other side wall of the tray. A space is established between the two wall panels, which is filled with insulation.

BRIEF DESCRIPTION OF THE DRAWINGS

For a further better understanding of these and other objects of the invention, reference will be made to the following detailed description of the invention which is to be read in association with the accompanying drawing, wherein.

DESCRIPTION OF THE INVENTION

Figure 1:
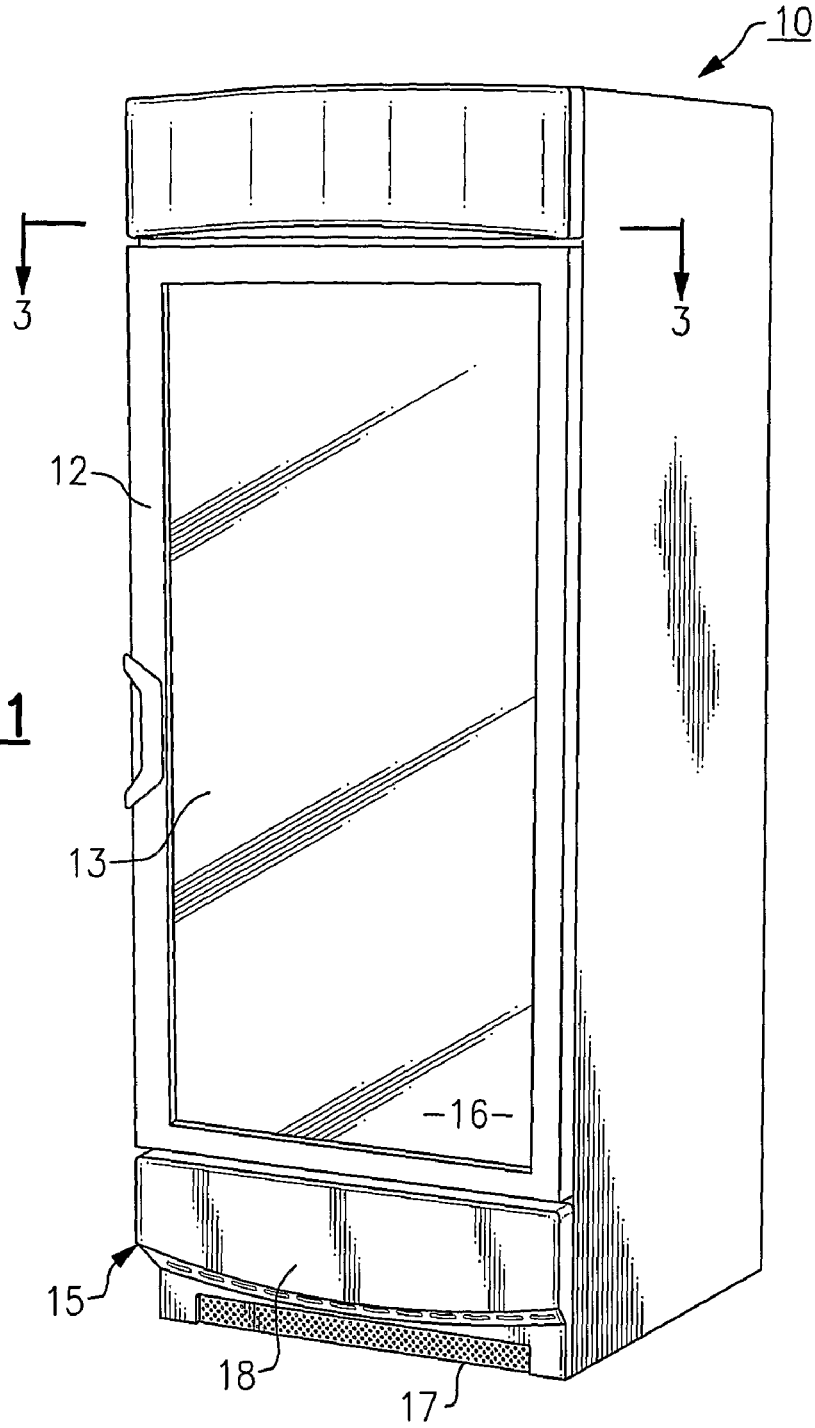
FIG. 1 is a perspective view of a refrigerated merchandiser employing wall sections that embody the teachings of the invention.
Figure 2:
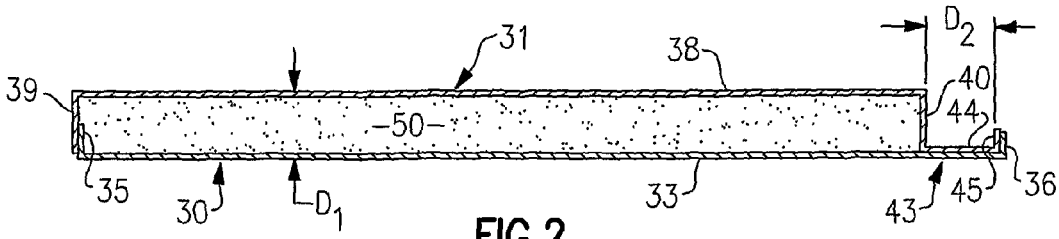
FIG. 2 is a top view in section of a wall section that embodies the present invention.
Figure 3:
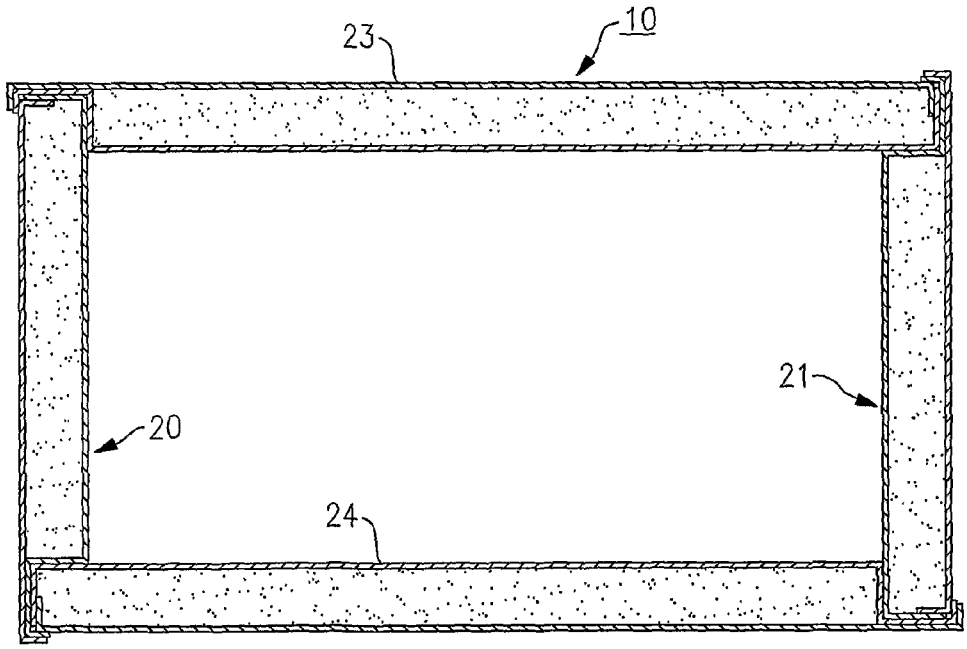
FIG. 3 is a section taken along lines 3-3 in FIG. 1 showing a number of wall sections that embody the invention interlocked in assembly.

Referring initially to FIG. 1-3 there is illustrated a refrigerated merchandiser, generally reference 10 that contains interlocking insulated wall sections which embody the teachings of the present invention. Although the present invention will be described with specific reference to a refrigerated merchandiser, it should become evident from the disclosure below that the invention has wider application and may be employed in association with any number of refrigerated enclosures requiring relatively strong insulated walls. The merchandiser includes a door 12 mounted in the front of the unit that opens into a refrigerated storage compartment for containing products such as canned and bottled beverages and other perishable or frozen consumables that necessitate storage within a controlled atmosphere. The door contains a transparent window 13 that allows a customer to view the contents of the unit without the need of opening the door.

The merchandiser includes a separate equipment compartment 15 that is isolated thermally from the refrigerated product compartment by means of an insulated floor panel 16. A refrigeration system (not shown) is housed within the equipment compartment that includes an evaporator unit and a condenser unit each being equipped with its own fan and being connected by a compressor in a conventional manner to produce a flow of refrigerated air from the system's evaporator into the product compartment. Warm air discharged from the condenser unit is passed out of the equipment compartment via a vent 17 located in the lower part of the merchandiser. An access panel 18 located over the vent which can be removed to allow a technician ready access to the refrigeration equipment.

Turning now to FIG. 3, the upper part of the merchandiser contains four insulated wall sections that are interlocked together so as to provide extremely tight joints at the corners to produce a rigid structure having high thermal integrity particularly in the corner regions. The four walls include two side walls 20 and 21, a back wall 23 which extend from the base of the unit to the top of the unit, and a front wall 24 that is foreshortened to accommodate the door and the equipment compartment access panel. Although not shown, the top of the unit is enclosed with an insulated ceiling panel.

Each wall section is of similar construction with the only differences being found in the height and the width of each section.

As illustrated in FIG. 2, each wall section includes a shell 30 that is enclosed by cover 31. The shell includes an outer panel 33 and two opposed end walls 35 and 36 that are mounted perpendicular to the outer panel to create a channel shaped structure.

The cover 31 includes an inner panel 38 which also has two opposed end walls 39 and 40 that are mounted perpendicular to the inner panel. End wall 39 is mounted in contact with the outside surface of end wall 35 of the shell while the opposite end wall 40 of the cover passes downwardly into the shell. An L-shaped flange 43 protrudes outwardly from the end wall 40 towards the opposite end wall 36 of the shell. The flange 43 contains a first leg 44 that is connected to the distal end of end wall 40 and which rests on the floor of the shell. The second leg 45 of the flange 43 is turned outwardly and rests in contact against the inside surface of end wall 36 of the shell. With the cover so mounted upon the shell the outer and inner panels of the wall section are held in parallel alignment with a space 50 being established between the two panels.

The shell 30 and cover 31 of each wall section is constructed of any suitable material, such as sheet metal, structural plastic, or any other suitable composite materials. The shell 30 and cover 31 of the wall section shown in FIG. 2 are formed from a single piece of sheet metal so that the individual sections of each are integrally joined. The end walls and the end flange each preferably extend across the entire width of the inner and outer panels, however in practice each may be broken up into a series of spaced apart segments without departing from the teachings of the present invention. When the wall sections are assembled as shown in FIG. 3, the cover 31 can be secured to the shell 30 using any one of well known fastening techniques such as mechanical fasteners, adhesive bonding, cladding, or pressure fits to form the desired hollow structure. Preferably, a tight sliding fit is provided between the shell 30 and the cover 31 so that the cover 31 fits snugly within the shell 30.

As best illustrated, four wall sections can be interlocked at the four corners of the unit by simply inserting the unflanged end of one section into the flanged end of its neighbor. The dimension $D_1$ over the two panels of each wall section is substantially equal to the inside dimension $D_2$ of the cover flange to provide a close running fit between the two wall sections that form a corner section of the structure. This interlocking feature insures that a tight structural joint is established at the corners resulting in an overall rigid structure.

The space or cavity 50 within each wall section is filled with a thermal insulating material 55 which can be polyurethane foam, fiberglass sheets or any other material that is capable of providing the necessary insulation. The joint formed by the interlocking wall sections insulates the corners of the enclosure providing for a thermally efficient assembly.

Figure 4:
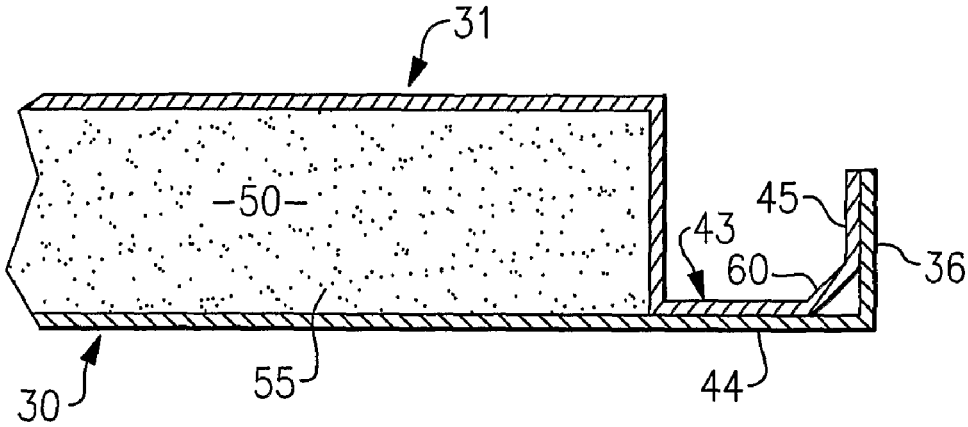
FIG. 4 is a partial top view showing a modified cover end flange.

Turning now to FIG. 4, there is illustrated a further embodiment of the invention wherein the end flange 43 of the cover is provided with a stiffening plate 60 that is mounted within the corner that is established between the two legs of the end flange. The stiffening plate is mounted at a 45° between the legs and extends substantially along the width of the cover. As noted above, the cover provides a tight running fit between the two end walls of the shell in assembly and the stiffening plate serves to furnish greater rigidity to the structure which helps prevent the cover from being dislodged once it is closed.

Figure 5:
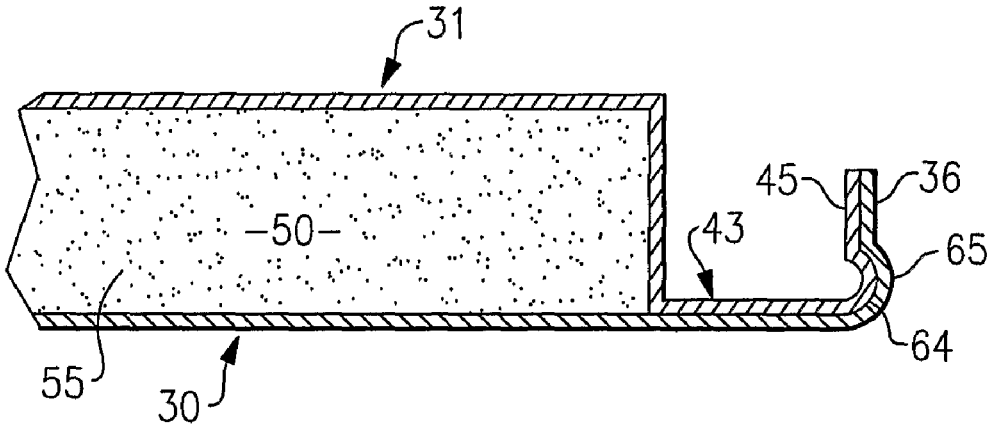
FIG. 5 is also a partial top view showing a further modified cover end flange.

FIG. 5 illustrates another embodiment of the invention wherein a detent 62 is established between the end flange 43 and the end wall 36 of the shell. The detent is formed by producing an outwardly protruding dimple 64 in the leg 45 of the flange adjacent to the flange corner and producing a complementary concave section 65 in the end wall 36. In this arrangement, the cover can be either snap fitted downwardly into the shell or moved laterally into the shell with the dimple of the flange in sliding relationship with the concave section of the end wall 36. The detent joint formed between the shell and the cover allows the cover to be more securely closed.

Figure 6:
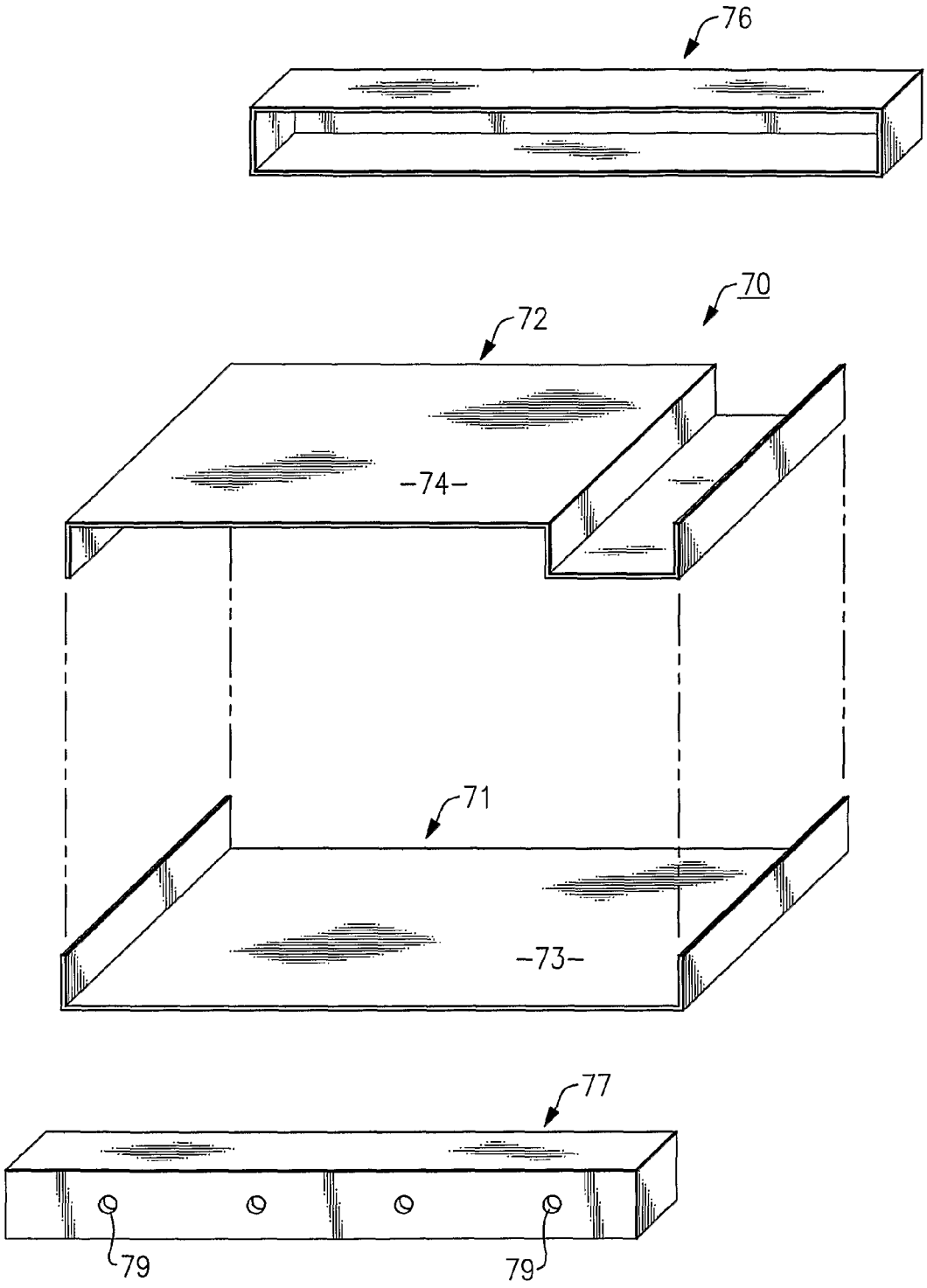
FIG. 6 is an exploded view in perspective showing a second embodiment of the invention.

FIG. 6 is an exploded view of a wall section 70 that includes a shell 71 and a cover 72 as described above that are capable of closing together to establish a space between the shell panel 73 and the cover panel 74 for containing insulation. The wall section 70 is provided with two side caps 76 and 77 that can be snap fitted over open sides of the wall section assembly and secured in place using any suitable fastening means. One or both side caps are provided with a series of injection ports 79-79 through which an insulating foam material can be passed into the space between the cover panel and the shell panel.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. A wall section for use in a refrigerated enclosure that comprises:

a shell having an outer panel and two parallel spaced apart end walls that are perpendicular to said outer panel;

a cover mounted over said shell that includes an inner panel having first and second end walls that are mounted perpendicular to said inner panel;

said first end wall of said cover being in contact with one end wall of said shell and said second end wall of said cover being mounted between the one end wall of the shell and the other end wall of the shell so that a space is established between the two panels; and an L shaped flange having a first leg connected to a distal end of said second end wall of said cover and a second leg that is in contact with said other end wall of said shell, wherein said second end wall of said cover, said first leg, and said second leg define an opening extending perpendicularly from said first leg with a width of said first leg, and whereby the inner and outer panels of one wall section are capable of being perpendicularly aligned in assembly with the inner and outer panels of another wall section.

2. The wall section of claim 1 that further includes an insulation material located in the space between said panels and said end walls of said cover.

3. The wall section of claim 1 wherein said first leg of said flange rests in contact with the outer panel of said shell.

4. The wall section of claim 1 wherein said shell and said cover are each fabricated from a single sheet of material.

5. The wall section of claim 4 wherein said shell and said cover are each fabricated of a structurally rigid material.

6. The wall section of claim 5 wherein said shell and said cover are each formed of sheet metal.

7. The wall section of claim 5 wherein said tray and said cover are each formed of a structural plastic material.

8. The wall section of claim 1 wherein the legs of said flange are joined by a corner piece that forms an acute angle with said outer panel.

9. The wall section of claim 1 that further includes a detent that acts between the second leg of the flange and the opposite side wall of the shell.

10. The wall section of claim 1 wherein the distance between the second end wall of the cover and the second leg of the flange is about equal to the distance over the shell and cover panels wherein said wall section can be interlocked with a second wall section having the same geometry.

11. The wall section of claim 1 that further includes side caps for enclosing the space between the inner and outer panels.

12. A wall section for use in a refrigerated enclosure that comprises:

a shell having an outer panel and two parallel spaced apart end walls that are perpendicular to said outer panel;

a cover mounted over said shell that includes an inner panel having first and second end walls that are mounted perpendicular to said inner panel;

said first end wall being in contact with one end wall of said shell and said second end wall being mounted between the one end wall of the shell and the other end wall of the shell so that a space is established between the two panels; and an L shaped flange having a first leg connected to a distal end of said second end wall of said cover and a second leg that is in contact with said other end wall of said shell whereby the inner and outer panels of one wall section are capable of being perpendicularly aligned in assembly with the inner and outer panels of another wall section; and side caps for enclosing the space between the inner and outer panels, said side caps containing one or more injection ports through which insulation may be injected into the space between the inner and outer panels.

* * * * *